US010265603B1

(12) United States Patent
Nation, Jr.

(10) Patent No.: US 10,265,603 B1
(45) Date of Patent: Apr. 23, 2019

(54) APPARATUS AND METHOD FOR SHAPING A BASEBALL GLOVE

(71) Applicant: Charles Nation, Jr., Lee's Summit, MO (US)

(72) Inventor: Charles Nation, Jr., Lee's Summit, MO (US)

( * ) Notice: Subject to any disclaimer, the term of this patent is extended or adjusted under 35 U.S.C. 154(b) by 0 days.

(21) Appl. No.: 15/995,628

(22) Filed: Jun. 1, 2018

Related U.S. Application Data

(60) Provisional application No. 62/575,004, filed on Oct. 20, 2017.

(51) Int. Cl.

| | |
|---|---|
| ***D06F 59/04*** | (2006.01) |
| ***A63B 71/14*** | (2006.01) |
| *A41D 19/04* | (2006.01) |
| *A63B 71/00* | (2006.01) |

(52) U.S. Cl.
CPC ..... *A63B 71/143* (2013.01); *D06F 59/04* (2013.01); *A41D 19/04* (2013.01); *A63B 71/0045* (2013.01)

(58) Field of Classification Search
CPC ..... A63B 71/143; D06F 59/04; A41D 19/04
USPC ..... 223/78
See application file for complete search history.

(56) References Cited

U.S. PATENT DOCUMENTS

| | | | | |
|---|---|---|---|---|
| 2,134,974 | A * | 11/1938 | Hurwitz | A47F 8/00 223/78 |
| 2,281,741 | A * | 5/1942 | Boulard | A47F 8/00 223/68 |
| 4,472,836 | A * | 9/1984 | Shikatani | D06F 59/04 2/169 |
| 4,877,162 | A * | 10/1989 | McGinley | A47G 25/92 223/78 |
| 4,928,320 | A * | 5/1990 | Aoki | A63B 71/143 2/19 |
| 5,285,529 | A * | 2/1994 | Arena | A63B 71/143 2/16 |
| 6,006,962 | A | 12/1999 | Ebeling, II | |
| 6,681,402 | B1 | 1/2004 | Bevier et al. | |
| 2011/0083340 | A1 | 4/2011 | Leary et al. | |
| 2012/0180191 | A1 | 7/2012 | McNamee | |
| 2017/0314182 | A1 | 11/2017 | Hollis | |

* cited by examiner

*Primary Examiner* — Nathan E Durham
(74) *Attorney, Agent, or Firm* — Hovey Williams LLP

(57) ABSTRACT

A method and apparatus for shaping a glove. The apparatus broadly includes an elongated shaping portion and a handle portion. The elongated shaping portion is made of a deformable material that holds its shape when bent without the use of heat and that is configured to be inserted into a single slot of the glove where a user's digit is positioned during use. The handle portion is connected to the shaping portion and is made of at least one of plastic, tape, and rubber.

10 Claims, 10 Drawing Sheets

APPARATUS AND METHOD FOR SHAPING A BASEBALL GLOVE

CROSS-REFERENCE TO RELATED APPLICATIONS

This application claims the benefit of U.S. Provisional Application Ser. No. 62/575,004, filed Oct. 20, 2017, entitled APPARATUS AND METHOD FOR SHAPING A BASEBALL GLOVE, the entire disclosure of which is hereby incorporated by reference herein.

BACKGROUND

Baseball and softball gloves often need to be shaped, or broken in, before use to form a pocket and reduce the stiffness thereof. Shaping a glove may include oiling the glove, putting a baseball, softball, or other solid object in the glove, closing the glove on or around the object, and then applying pressure to the glove so that it remains closed or around the object. Pressure may be applied by tying rubber bands, rope, or string around the glove. Pressure may also be applied by placing the glove beneath a heavy object. Current methods may also include using heated material for holding the glove in place. However, these methods may damage the glove or are unnecessarily complicated or difficult to employ.

The background discussion is intended to provide information related to the present invention which is not necessarily prior art.

SUMMARY

The present invention solves the above-described problems and other problems by providing a distinct advance in the art of preparing a glove. More particularly, the present invention provides a method and device for shaping a glove.

In a first aspect, a glove-shaping device for shaping a glove in preparation for use. The glove-shaping device broadly includes a plurality of axially-extending shaping members. Each shaping member includes an elongated shaping portion and a handle portion. The elongated shaping portion is bendable along the length thereof and includes a deformable material that holds its shape when bent without the use of heat, e.g. at ambient temperature. The handle portion may be connected to the shaping portion and includes at least one of plastic, tape, and rubber. The shaping members are stacked alongside one another so that corresponding elongated shaping portions are at least partly axially, coextensive and configured to engage the at least one movable glove element.

In another aspect, a method of shaping a glove to form a pocket therein broadly includes the step of providing a first shaping member and a second shaping member. Each shaping member includes an elongated shaping portion made of a deformable material that holds its shape when bent without the use of heat, and a handle portion connected to the shaping portion made of at least one of plastic, tape, and rubber. The method also broadly includes the steps of inserting the first shaping member into a first slot of the glove where a user's digit is positioned during use; inserting the second shaping member into a second slot of the glove where a user's digit is positioned during use; and deforming the glove to a desired shape. The first shaping member and the second shaping member hold the glove in the desired shape.

In another aspect, a glove-shaping device for shaping a glove in preparation for use, the glove-shaping device broadly including a plurality of glove-shaping members and an aperture. Each glove-shaping member broadly includes a deformable body and a handle portion. The body holds its shape when bent without the use of heat and that is configured to be inserted into a single slot of the glove where a user's digit is positioned during use. The handle portion overlies an exterior surface of a portion of the deformable body. The handle portion is made of at least one of plastic, tape, and rubber. The aperture is positioned at an end of the deformable body.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
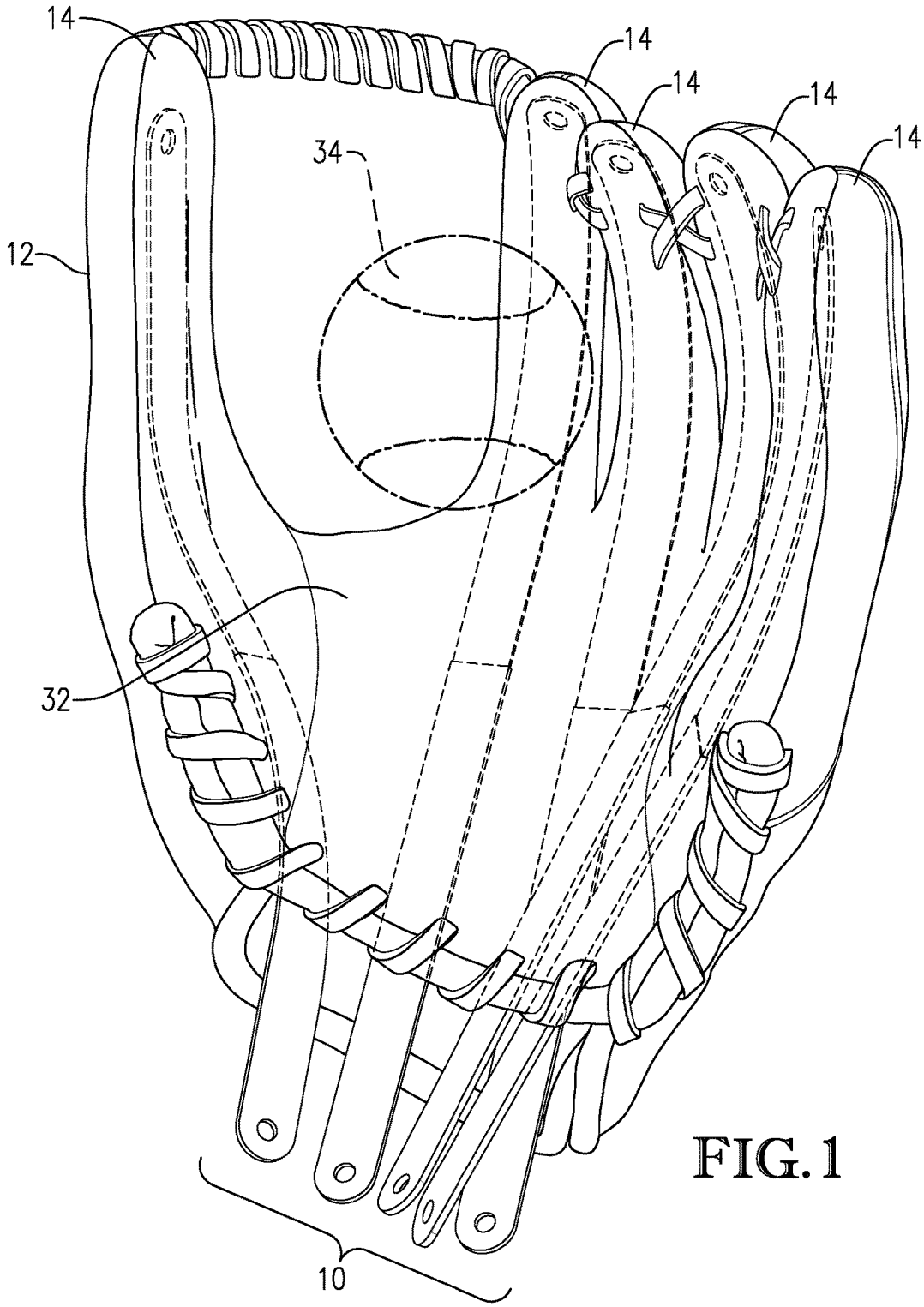
FIG. 1 is a front perspective view of a glove-shaping device constructed in accordance with one embodiment of the present invention, showing multiple shaping members of the device inserted into a glove.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

The devices and methods described herein generally comprise a rigid, shapeable or otherwise deformable, device for shaping a glove as shown in FIG. 1. The glove-shaping device 10 engages a glove 12 having movable glove elements 14 for shaping the glove 12. In various embodiments, the glove 12 may be a baseball glove, softball glove, mitt, catcher's mitt, fielding glove, first baseman's glove, or the like. The movable glove element 14 may be a portion of the glove that receives the digits of the user and that is movable by the digits of the user, such as the finger of a glove, the portion of a mitt that receives the user's digits, etc. The glove elements 14 are each preferably configured to receive a single finger of a user. However, the principles of the present invention are equally applicable where one or more alternative glove elements are configured to receive multiples fingers of a user. For instance, the glove could comprise a conventional catcher's mitt having a pair of glove elements, with one of the glove elements operable to receive four (4) fingers therein.

The glove-shaping device 10 may be comprised of a plurality of axially-extending shaping members 16. The shaping members 16 may be made of any deformable material including metal, such as, for instance, aluminum, carbon steel, stainless steel, copper, other metallic alloys, and the like. The shaping members 16 may also be made of deformable plastic, polymer material, or the like. The shaping members 16 may have any shape including an elongated strip, a wire, or the like. The shaping members 16 may have many sizes depending on a size of the glove 12 sought to be shaped and the strength needed to hold the glove's 12 shape. It is also within the scope of the present invention where the glove-shaping device includes an alternative number of shaping members positioned in a respective glove element. For example, the glove-shaping device could be configured so that at least one of the glove elements receives only a single shaping member therein.

Figure 2:
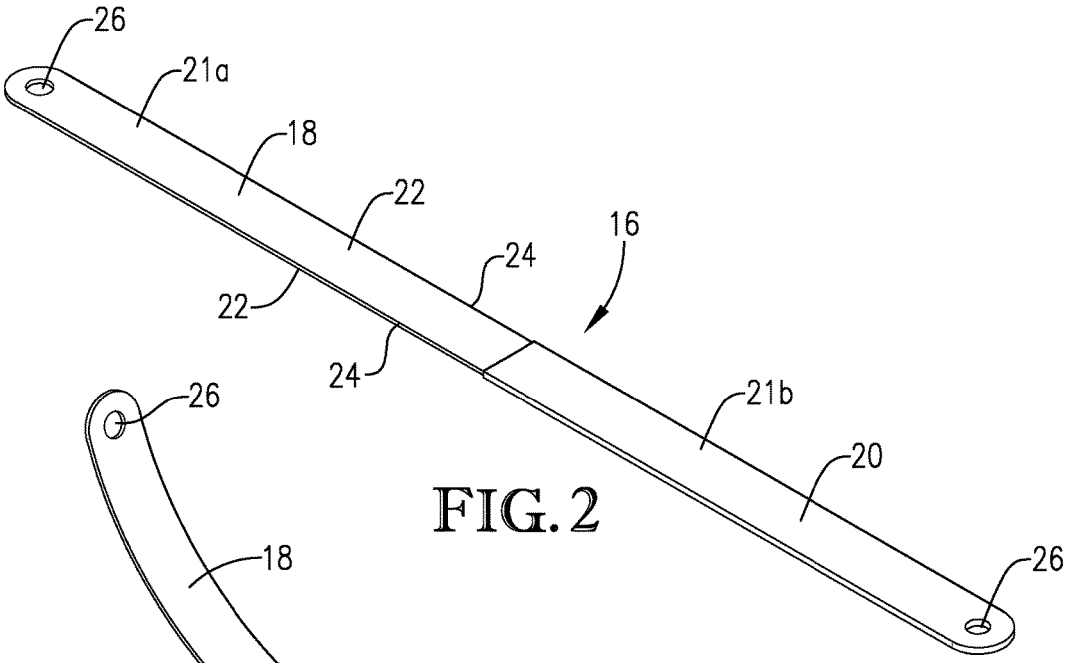
FIG. 2 is a fragmentary perspective view of one of the shaping members of FIG. 1, showing a shaping portion and a handle portion of the shaping member, with the shaping member in a generally unflexed condition.
Figure 3:
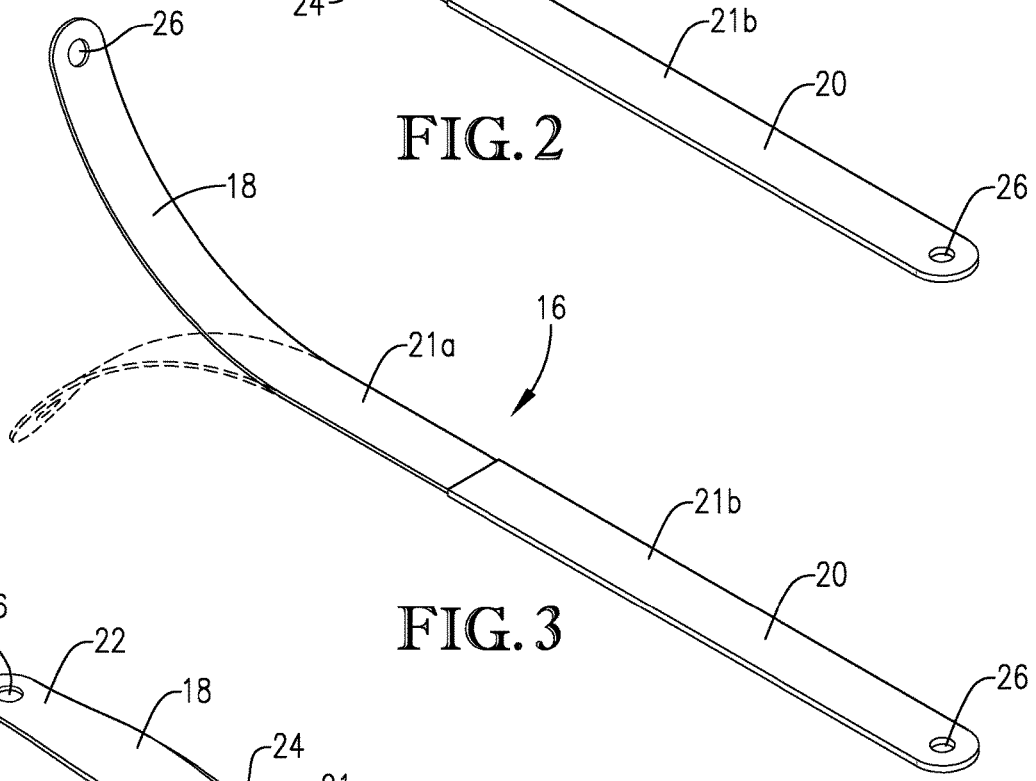
FIG. 3 is a perspective view of the shaping member similar to FIG. 2, but showing a distal end of the shaping member flexed transversely to an axis of the shaping member so that the shaping portion is bent into a flexed condition.
Figure 4:
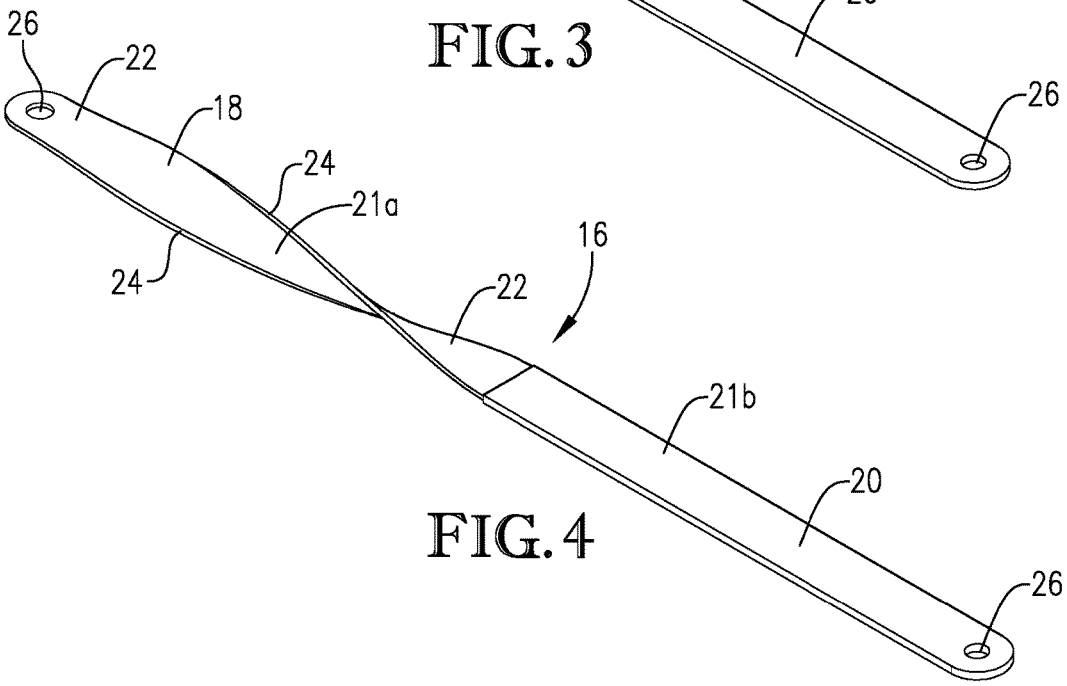
FIG. 4 is a perspective view of the shaping member similar to FIG. 2, but showing the distal end of the shaping member rotated about the axis of the shaping member so that the shaping portion is bent into another flexed condition.

As shown in FIGS. 2-4, each shaping member 16 generally includes a shaping portion 18 and a handle portion 20. In the illustrated embodiment, the shaping portion 18 and handle portion 20 present a distal end and a proximal end, respectively, of the shaping member 16. Both the shaping portion 18 and handle portion 20 of each shaping member 16 may include a common substrate layer 21*a* (see FIGS. 2-4). In other words, each shaping member 16 may be a "full tang" construction. In the illustrated embodiment, the substrate layer 21*a* preferably comprises a deformable metallic material, such as, for instance, aluminum, carbon steel, stainless steel, copper, other metallic alloys, and the like. However, the substrate layer could additionally or alternatively include a synthetic resin material without departing from the scope of the present invention.

The depicted shaping portion 18 is preferably devoid of any layers other than the substrate layer 21*a*, so that the substrate layer 21*a* presents the faces 22 of the shaping portion 18. The faces 22 of the shaping portion 18 preferably have a relatively low coefficient of friction. In the illustrated embodiment, this configuration is provided by forming the substrate layer 21*a* to have smooth opposite surfaces (e.g., by polishing) that define the faces 22.

However, it is within the scope of the present invention where the shaping portion has one or more additional layers. For instance, one or more coating layers could be applied to a substrate layer in a covering relationship relative thereto. Such coating layers could include one or more synthetic resin materials. In one such alternative embodiment, a low-friction material (e.g., a polytetrafluoroethylene material) could be coated onto the substrate layer (e.g., as a covering layer).

The handle portion 20 preferably also includes a coating layer 21*b* applied to the substrate layer 21*a*, with the coating layer 21*b* substantially covering the substrate layer 21*a* of the handle portion 20 (see FIGS. 2-4). In this manner, the coating layer 21*b* preferably presents the faces 22 of the handle portion 20. However, it is also within the scope of the present invention where the coating layer does not entirely cover the substrate layer of the handle portion. In the depicted embodiment, the faces 22 of the handle portion preferably have a relatively high coefficient of friction. The frictional coefficient of the faces 22 presented by the handle portion 20 is preferably greater than the frictional coefficient of the faces 22 presented by the shaping portion 18.

While the illustrated configuration of layers in the handle portion is preferred, it is also within the ambit of the present invention where the handle portion includes an alternative layer arrangement. For instance, the handle portion could include multiple coating layers. For some aspects of the present invention, the handle portion could be devoid of a coating layer (e.g., where high-friction faces are provided by knurling or otherwise texturing the surfaces of the substrate layer associated with the handle portion).

The coating layer 21*b* of the handle portion 20 preferably comprises a synthetic resin material and, more preferably, includes an elastomeric material. In the depicted embodiment, the handle portion 20 is coated in a layer of liquid rubber that is cured so as to provide a protective surface on the handle portion 20. So coated, the handle portion 20 provides a buffer for protecting a user and/or the glove 12 from injury or damage due to a sharp edge that may be found on the handle portion 20 of the glove-shaping device 10. However, the coating layer of the handle portion 20 could alternatively or additional include other materials such as plastic, tape, or any other material that is suitable for gripping.

It will also be appreciated that the handle portion 20 could be made of, or coated with, any material having any color so as to match school or athletic club colors. Again, in some embodiments, the shaping portion 18 could also be coated with a material so as to protect the glove 12 and having any color so as to match the colors of a school, athletic club, or the handle portion 20.

Various other embodiments may be constructed in which the shaping portion 18 and the handle portion 20 are constructed of different materials having different rigidity and deformability to aid in the use of the glove-shaping device 10. The shaping portion 18 and handle portion 20 may be of the same length or different lengths depending on the size and/or shape of the glove 12.

Each shaping member 16 preferably presents opposite axially-extending faces 22 and opposite axially-extending edges 24. The edges 24 may generally be parallel to one another. In some embodiments, the edges 24 may be rounded to prevent damage to the user and/or glove. The faces 22 cooperatively define a thickness of the shaping member 16, with the shaping portion 18 having a thickness that is substantially constant along the length thereof. Similarly, the illustrated handle portion 20 preferably has a thickness that is substantially constant along the length thereof. However, it is also within the ambit of the present invention where one or more features of the shaping member have an alternative shape.

Figure 5:
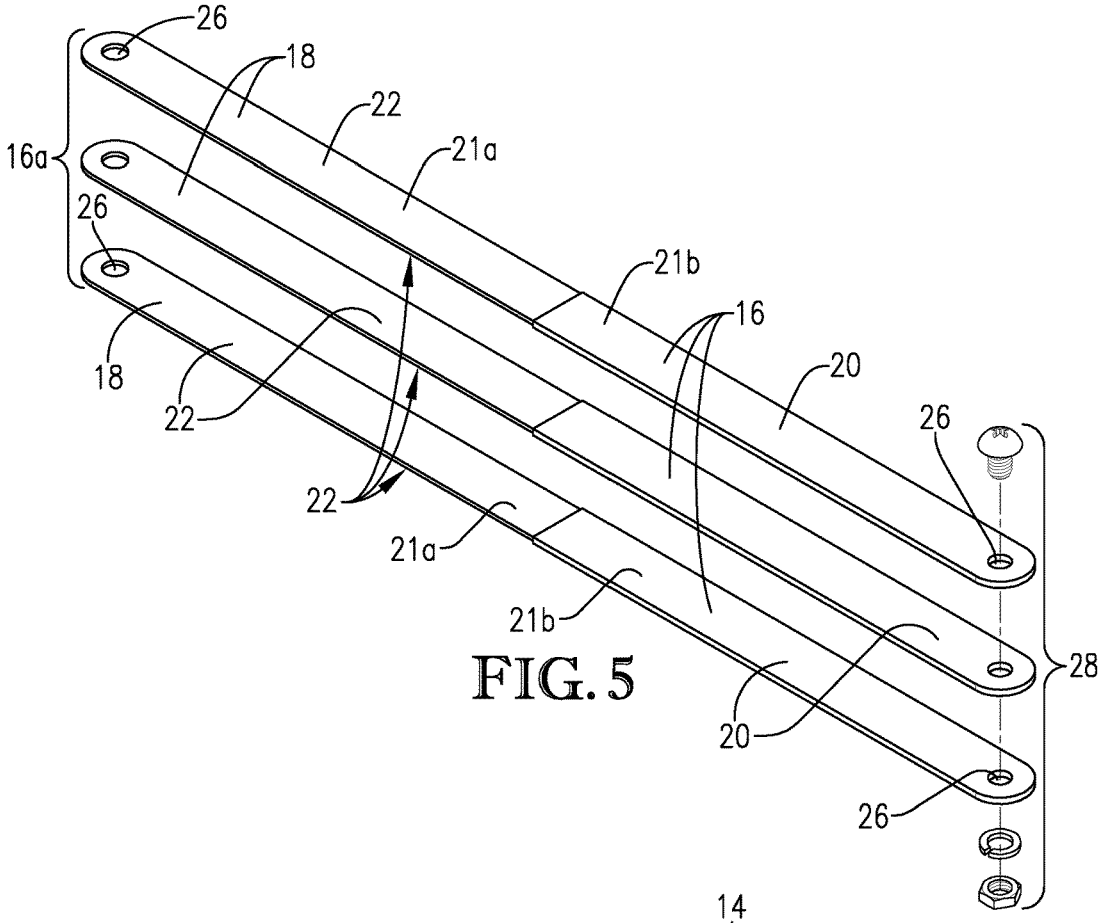
FIG. 5 is an exploded perspective view of a stack of shaping members depicted in FIGS. 1-4, with the shaping members stacked in series and arranged in registration with one another, and with a fastener configured to removably secure the shaping members together.
Figure 6:
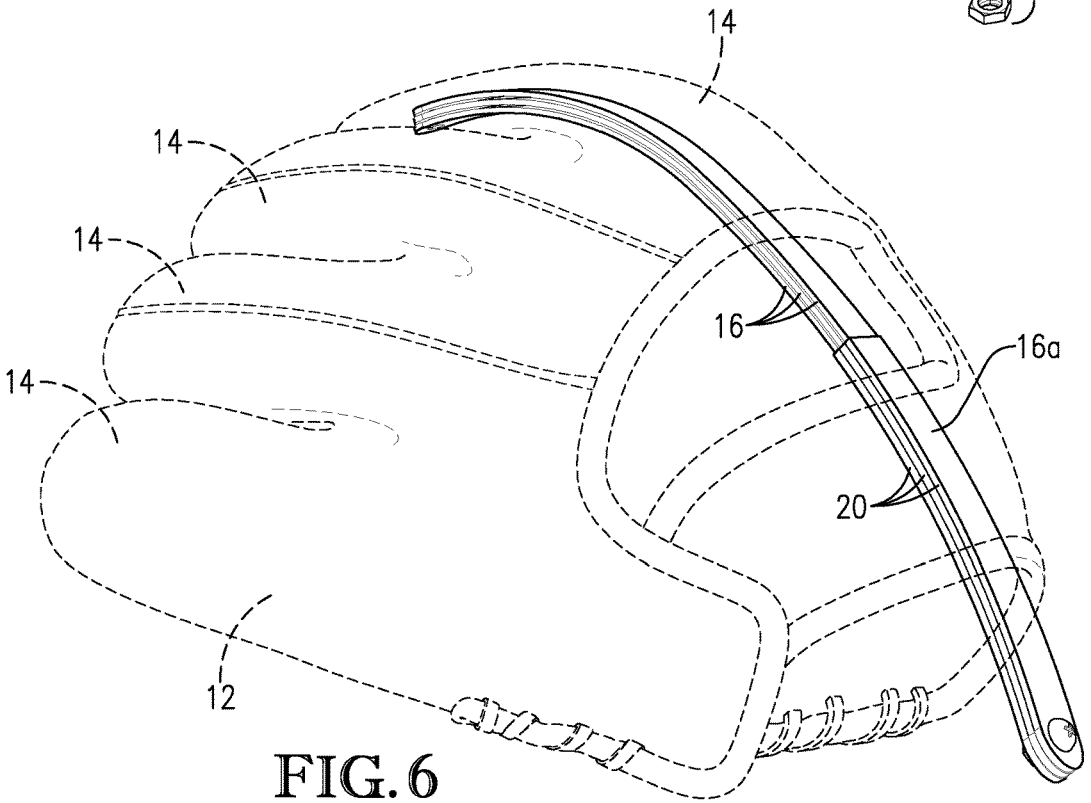
FIG. 6 is a perspective view of the stack of shaping members shown in FIG. 5, with the stack being inserted into the glove.

In a preferred embodiment, the shaping members 16 are configured to be stacked alongside one another so that they are substantially axially, coextensive, as shown in FIGS. 5 and 6. In particular, adjacent pairs of shaping members 16 are arranged so that corresponding faces 22 are generally in face-to-face engagement with one another (see FIG. 6). Furthermore, the engaged pairs of faces 22 are preferably in substantial registration with one another so that faces 22 of the shaping portions 18 engage one another and faces 22 of the handle portions engage one another.

Engagement between the pairs of faces 22 of adjacent handle portions 20 provides frictional engagement between the corresponding adjacent pairs of shaping members 16 and thereby serves to restrict relative sliding movement between the engaged shaping members 16. This is particularly so when the shaping members 16 are secured to one another by the fastener 28. However, the frictional engagement between adjacent handle portions 20 does permit at least some bending of the stack 16*a* along the handle portions (e.g., to promote bending of the stack 16*a* along the shaping portions 18).

Frictional engagement between the pairs of faces 22 of adjacent shaping portions 18 preferably permits some relative lateral sliding movement between the engage shaping portion 18, particularly along the axial direction (e.g., during bending of the stack 16*a*). This low-friction engagement particularly enables bending of the stack 16*a* of shaping portions 18 to conveniently curve and form the stack 16*a*, especially along the shaping portions 18. More preferably, the frictional engagement between faces 22 of shaping portions 18 is relatively less than the frictional engagement between faces 22 of handle portions 20.

However, the principles of the present invention are equally applicable whether the stack of shaping members is alternatively configured. For instance, the shaping members 16 could be stacked so that they are only partly axially coextensive with one another. The stack 16*a* of shaping members 16 are preferably removably received within one of the movable glove elements 14 and cooperatively engage the movable glove element 14 of the glove 12, as shown in FIG. 6.

Figure 7:
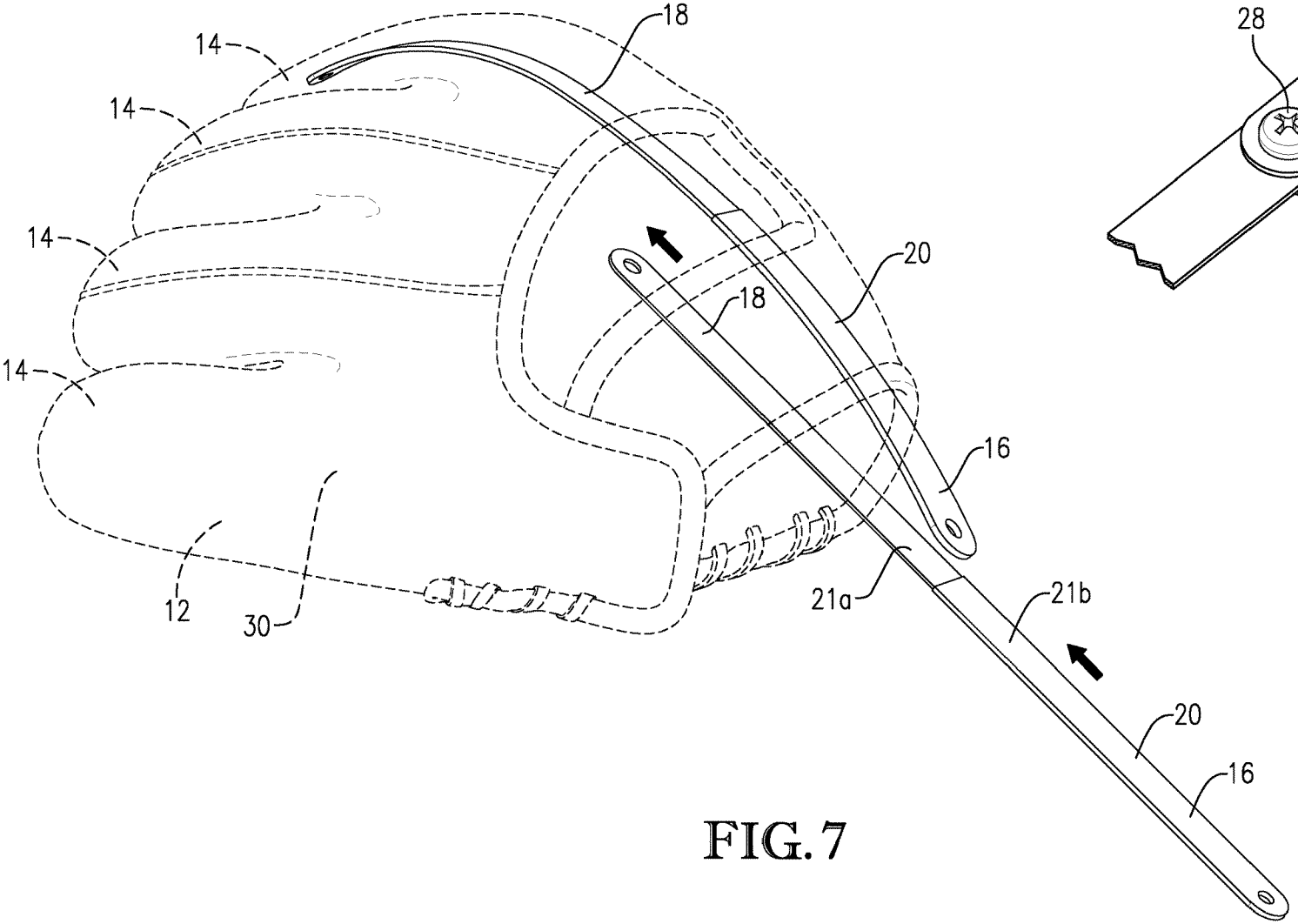
FIG. 7 is a perspective view of shaping members shown in FIGS. 1-4, with the shaping members being inserted into a glove.

In alternative embodiments, the shaping members 16 may be partially axially coextensive with one another when stacked and positioned in a single glove element. It will also be appreciated that the shaping members may be partially axially coextensive with each other at various times while shaping members 16 are serially installed in a single movable glove element 14, as shown in FIG. 7.

Each shaping member 16 preferably presents proximal and distal apertures 26 located adjacent to corresponding proximal and distal ends of the shaping member 16. However, one or more shaping members could include an alternative number of apertures (e.g., where the shaping member has only a single aperture adjacent the proximal end). It will also be appreciated that one or more apertures 26 may be positioned anywhere on the glove-shaping device 10. In some embodiments, the apertures 26 are on each end of the shaping members 16.

The depicted apertures 26 are preferably configured to receive a fastener 28 that enables multiple shaping members 16 to be stacked on top of each other. Preferably, when the shaping members 16 are stacked in registration with one another, the proximal apertures 26 of the shaping members 16 are located in substantial registration with each other and the distal apertures 26 are located in substantial registration with each other. This arrangement enables securement of the fastener 28 through the corresponding apertures 26 (see FIGS. 5 and 6).

Figure 8:
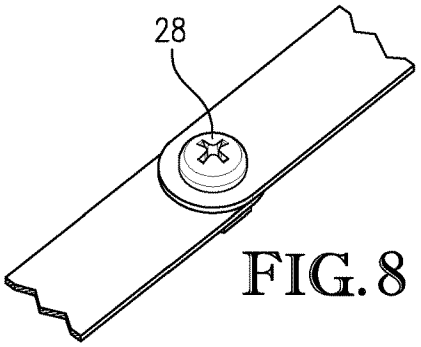
FIG. 8 is a fragmentary perspective view of shaping members shown in FIGS. 1-4, with a fastener attaching two ends of two shaping members.
Figure 9:
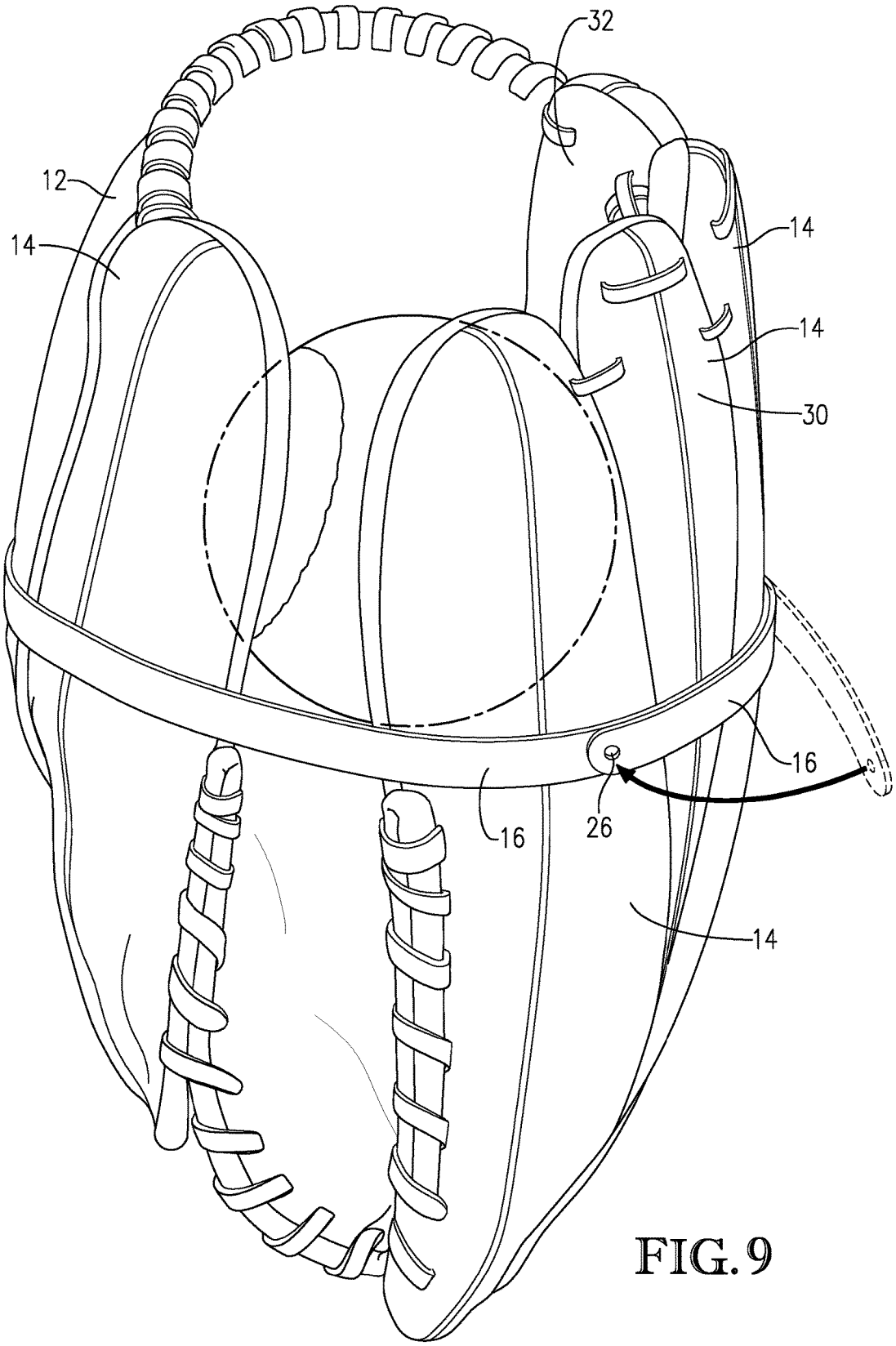
FIG. 9 is a front perspective view of the glove and shaping members shown in FIGS. 1-4, showing the glove with attached shaping members wrapping around the glove.
Figure 14:
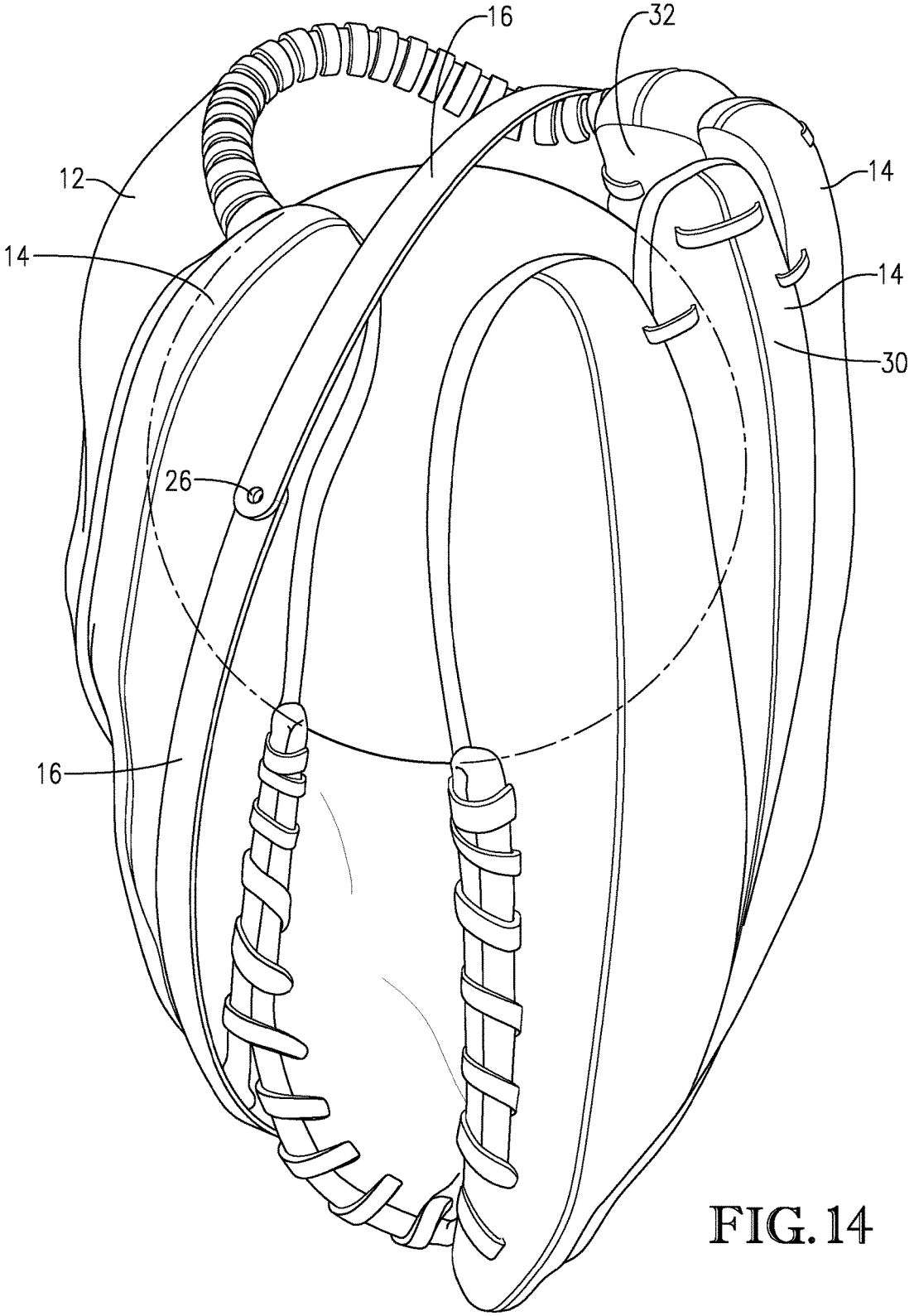
FIG. 14 is a front perspective view of the glove and shaping members shown in FIGS. 1-4, showing the glove with attached shaping members wrapping around the glove.

It will also be understood that the apertures 26 accommodate other configurations for connecting multiple shaping members 16 together. For instance, the apertures 26 also preferably enable a user to attach a ring (such as a key ring) through the apertures 26 of multiple shaping members 16 (e.g., for storing multiple glove-shaping devices 10 thereon). The apertures 26 may also be used for hanging the glove-shaping device 10 on a wall with a nail or hook. This provides more versatility when using the glove-shaping device 10, for gloves may vary in stiffness and therefore require a different number of shaping members 16 to hold a desired shape. It also enables a user to prepare a glove 12 using a shape that may be relatively more difficult to hold and therefore requires multiple shaping members 16 to hold that exact shape. Further, the aperture 26 may be used for attaching multiple shaping members 16 together end-to-end (see FIGS. 8 and 9). Attaching multiple shaping members 16 together end-to-end forms a longer deformable object, which may be used for wrapping around a glove 12 and applying external pressure to the glove 12, as illustrated in FIGS. 9 and 14. The multiple shaping members 16 may be horizontally wrapped around the glove 12, as shown in FIG. 9, which shapes the glove 12 so that horizontal squeezing of the glove 12 is less difficult for the user. Alternatively or additionally, the multiple shaping members 16 may be vertically wrapped around the glove 12, as shown in FIG. 14, applying pressure to a top portion of the glove 12, thereby developing a deeper pocket. It is foreseen that any number of multiple shaping members 16 attached end-to-end may be wrapped around the glove 12 in any number of orientations without departing from the spirit of the present invention.

The shaping portion 18 and handle portion 20 of the shaping member 16 are configured to engage one or more movable glove elements 14 of the glove 12. However, in some applications, the shaping portion 18 could be primarily used to engage and shape the glove elements such that the handle portion 20 is not engaged with a glove element or any other part of the glove.

Figure 10:
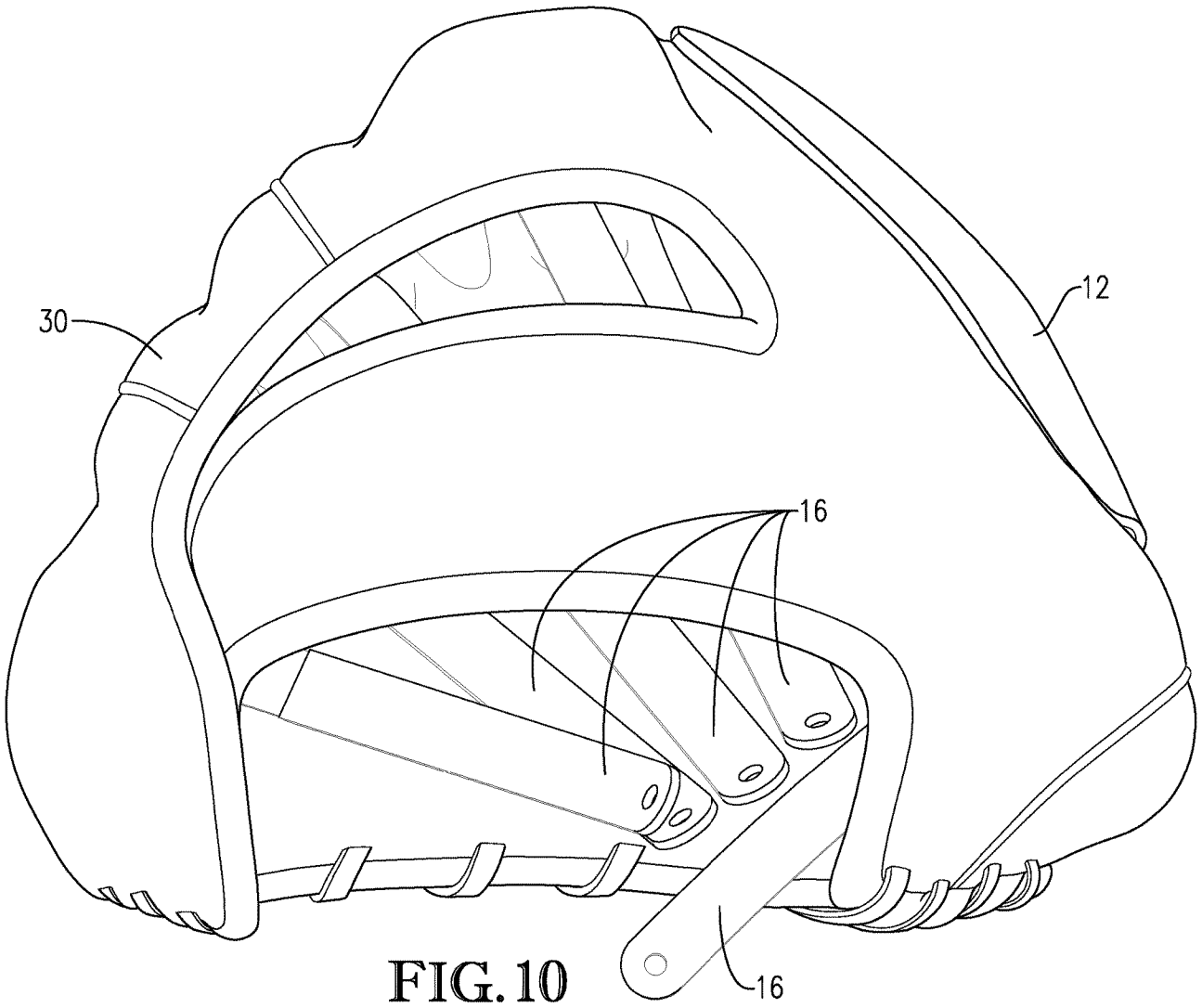
FIG. 10 is a bottom perspective view of the glove-shaping device of FIG. 1 inserted into a glove.
Figure 11:
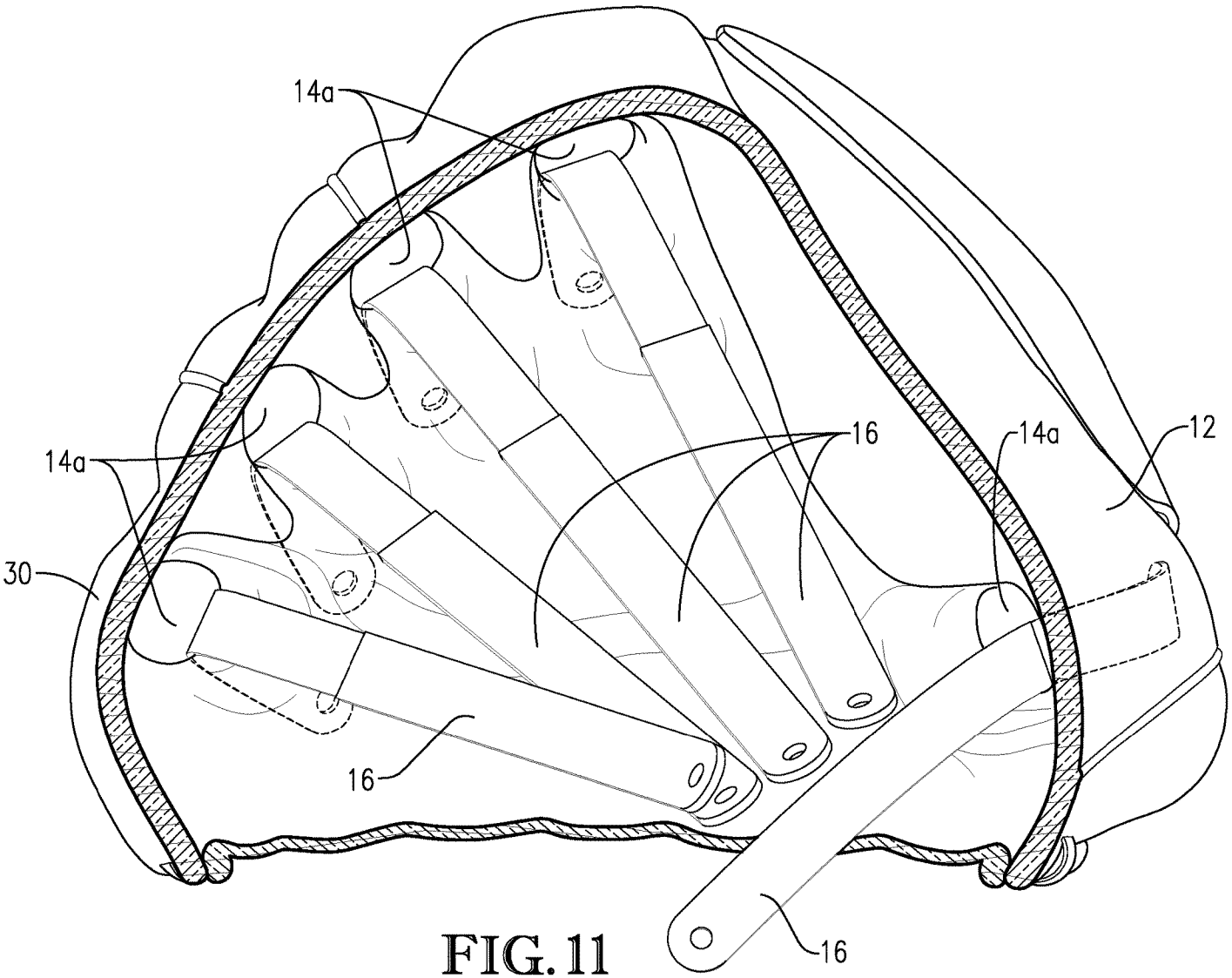
FIG. 11 is a cross-sectional view of the glove-shaping device similar to FIG. 10, but showing a bottom part of the glove removed to show internal glove slots receiving the shaping members.
Figure 12:
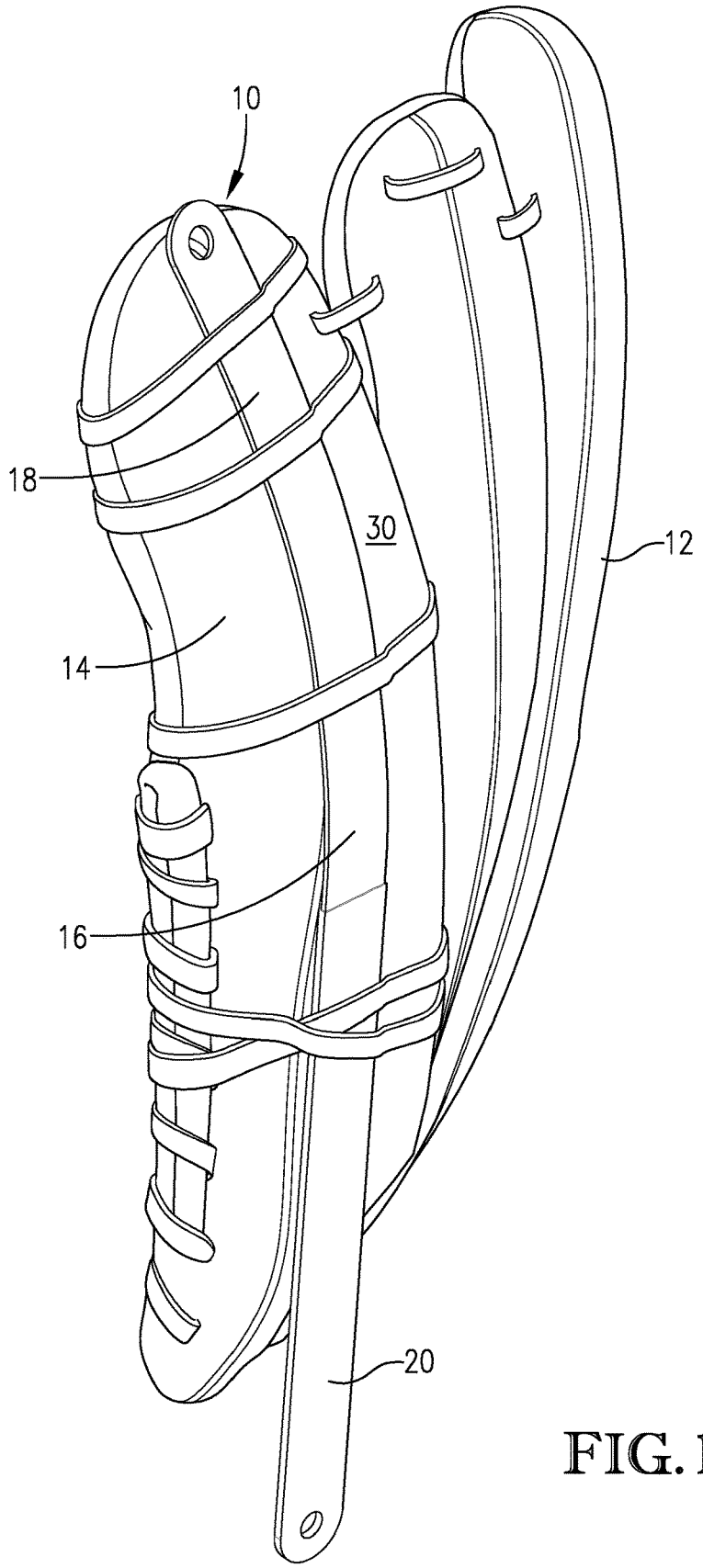
FIG. 12 is a view of glove-shaping device of FIG. 1 attached to an exterior surface of the glove.

In a preferred embodiment, the shaping portion 18 is configured to be inserted in a slot 14*a* of the glove 12 where the user's digit occupies during use, as shown FIGS. 10 and 11. However, in some alternative embodiments, the shaping portion 18 of the glove-shaping device 10 may be removably attached to an exterior surface 30 or interior surface 32 of the glove 12. The glove-shaping device 10 may be attached using any method, such as strings, bands, rubber bands, straps, or the like. For example, the user may utilize any straps, bands, or strings of the glove 12 to act as ties for securing the glove-shaping device 10 to the exterior surface 30 of the glove 12, as shown in FIG. 12. The shaping portion 18 of the glove-shaping device 10 preferably presents a rounded distal end to facilitate insertion of the shaping portion 18 into the slots 14*a* of the glove 12. In this manner, the device 10 is shaped to restrict the distal ends from catching on the material of the glove 12 and facilitate deeper insertion of the device 10 within the slots.

In use, the glove-shaping device 10 is engaged with the movable glove elements 14 of the glove 12. In a preferred embodiment, a plurality of shaping members 16 are inserted into the slots 14*a* of the glove 12 with the shaping portions 18 entering the slots 14*a* first and the handle portion 20 being used to grip the glove-shaping device 10. The user may select which slot 14*a* of the cavity 18 to insert the one or more shaping members 16. The user may insert the glove-shaping device 10 into one or more slots 14*a*. For example, the user may insert one or more shaping members 16 into the slot 14*a* intended for the thumb and/or the slot 14*a* intended for the middle finger. In one embodiment, the user puts one or more shaping members 16 in each slot 14*a* of the glove 12.

Figure 13:
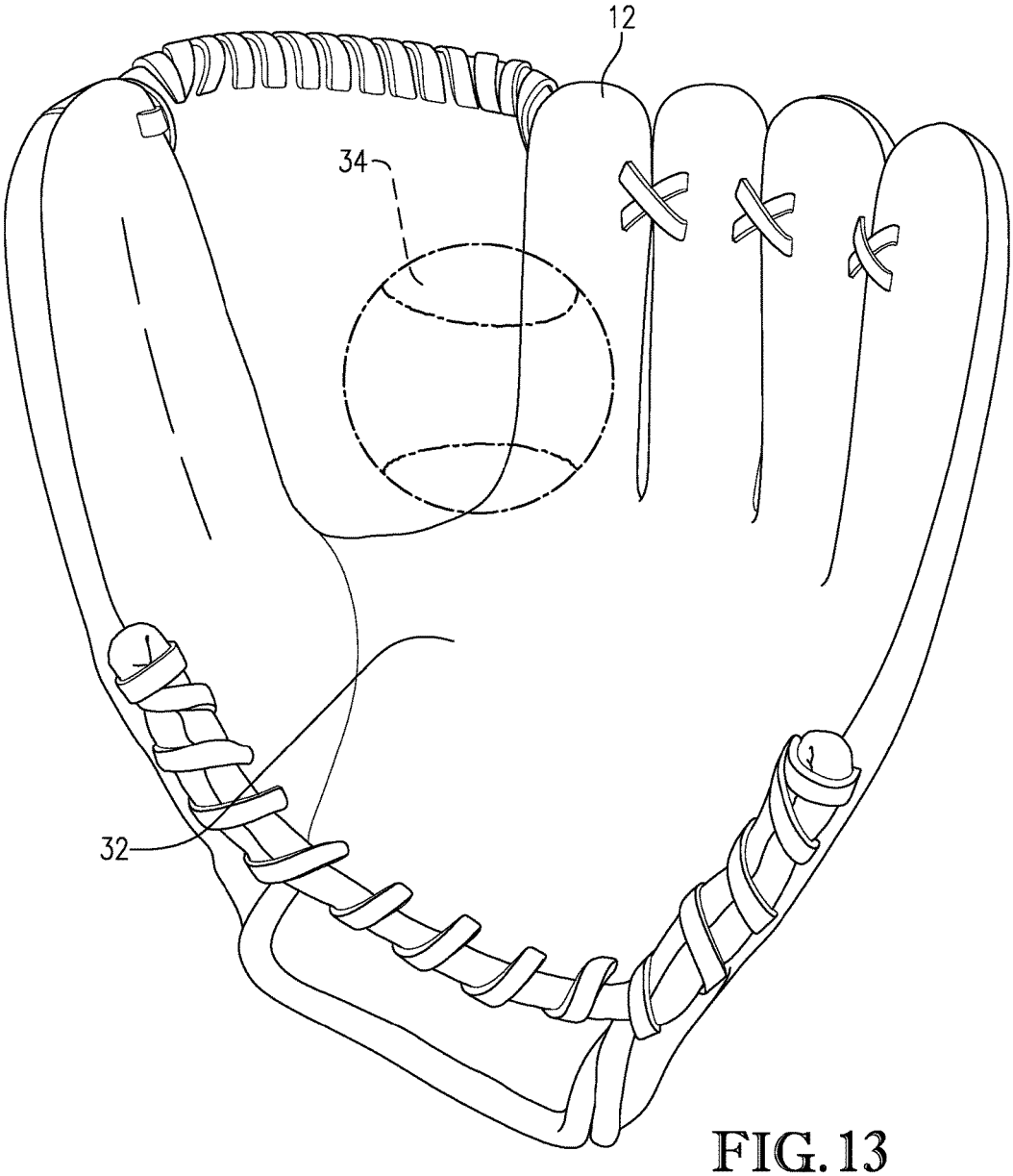
FIG. 13 is a view of a glove having a hard object in a pocket thereof.

A hard object 34, such as a baseball, softball, or the like may be placed in the glove 12, as shown in FIG. 13. Pressure is applied to the glove 12 so that the glove 12 closes around the object 34. When the glove 12 is closed around the object 34, the shaping portion 18 of the one or more shaping members 16 inside the glove 12 deforms or bends on or around the object 34 in a manner suitable to the user to obtain the desired shape of the glove 12, as shown in FIG. 1, where the shaping members 16 are bent inside the glove 12. When the pressure is no longer applied to the glove 12, the shaping portion 18 maintains its shape on or around the object 34. The shaping portion 18 maintaining its shape causes the glove 12 to maintain its shape enclosed around the object 34, thereby forming a pocket where the object 34 is positioned. Thus, the glove-shaping device 10 is able to hold its shape and the shape of the glove 12 without the use of heat. Without the use of heat, the shaping process is simplified and reduces the chance of injury or damage. This is advantageous because children, who often struggle to appreciate the dangers of heating things, often shape their gloves on their own. Once the glove 12 has been shaped, the one or more shaping members 16 are removed by pulling on the handle portion 20. In some embodiments of the method, the glove 12 may be oiled prior to, during, or after applying force to the glove 12. In some embodiments, the glove-shaping device 10 may be re-inserted or applied to the glove 12 after use of the glove 12 during storage so that the glove 12 maintains the desired shape.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A glove-shaping device, operable to be positioned in engagement with a movable glove element for shaping a glove in preparation for use, the glove-shaping device comprising:

a plurality of axially-extending shaping members, each shaping member including an elongated shaping portion and a handle portion;

said elongated shaping portion being bendable along the length thereof and including a deformable material that holds its shape when bent without the use of heat;

said handle portion connected to the shaping portion and including at least one of plastic, tape, and rubber;

said plurality of shaping members being stacked alongside one another to provide one or more adjacent pairs of elongated shaping portions that are engaged and are at least partly axially, coextensive and configured to engage the movable glove element; and said elongated shaping portions each presenting opposite axially-extending faces and opposite axially-extending edges, with each adjacent pair of shaping portions having respective axially-extending faces engaged with one another.

2. The glove-shaping device of claim 1, said axially-extending shaping members further including an aperture.

3. The glove-shaping device of claim 2, each of said axially-extending shaping members including an aperture on respective the shaping portion.

4. The glove-shaping device of claim 1, wherein said edges of each pair of adjacent shaping portions being generally parallel to one another.

5. The glove-shaping device of claim 1, wherein said opposite axially-extending edges are round.

6. The glove-shaping device of claim 1, wherein the elongated shaping portion and the handle portion are full tang.

7. The glove-shaping device of claim 1, each of said axially-extending shaping members including an aperture on the respective handle portion.

8. The glove-shaping device of claim 7, further comprising a fastener secured to the apertures of the handle portions.

9. The glove-shaping device of claim 1, wherein each shaping member includes a coating for protecting the movable glove element from damage when inserting the shaping member into the movable glove element.

10. The glove-shaping device of claim 1, wherein the shaping portion includes aluminum.

* * * * *